US007354394B2

(12) United States Patent
Slattery, III et al.

(10) Patent No.: US 7,354,394 B2
(45) Date of Patent: Apr. 8, 2008

(54) SOFT TISSUE PLACEMENT OF IMPLANTABLE MICROPHONE

(75) Inventors: William Howard Slattery, III, La Canada, CA (US); Robert Edwin Schneider, Erie, CO (US); James Frank Kasic, II, Boulder, CO (US)

(73) Assignee: Otologics, LLC, Boulder, CO (US)

( * ) Notice: Subject to any disclaimer, the term of this patent is extended or adjusted under 35 U.S.C. 154(b) by 0 days.

(21) Appl. No.: 11/425,284

(22) Filed: Jun. 20, 2006

(65) Prior Publication Data

US 2007/0021647 A1 Jan. 25, 2007

Related U.S. Application Data

(60) Provisional application No. 60/692,224, filed on Jun. 20, 2005.

(51) Int. Cl.
*H04R 25/00* (2006.01)

(52) U.S. Cl. ..... 600/25

(58) Field of Classification Search ..... 600/25; 623/10, 11.11; 607/55–57
See application file for complete search history.

(56) References Cited

U.S. PATENT DOCUMENTS 5,085,628 A * 2/1992 Engebretson et al. ..... 600/25
6,517,476 B1 2/2003 Bedoya et al.
2001/0056300 A1* 12/2001 Kennedy ..... 623/10
2002/0091337 A1* 7/2002 Adams et al. ..... 600/559
2005/0101832 A1 5/2005 Miller et al.

* cited by examiner

*Primary Examiner*—Charles A. Marmor, II
*Assistant Examiner*—Christine D Hopkins
(74) *Attorney, Agent, or Firm*—Marsh Fischmann & Breyfogle LLP

(57) ABSTRACT

Provided herein are systems and methods where an implantable microphone of an implantable hearing system is positioned at a location spaced from the surface of the patient's skull. More specifically, the microphone is mounted to soft tissue of the patient to at least partially isolate the microphone from skull-borne vibrations. Accordingly, by utilizing a soft tissue mount, the microphone may be made more sensitive to ambient sounds with reduced concern to amplification of non-ambient vibrations caused by skull-borne vibrations including, for example, transducer feedback, talking and/or chewing. The system will further include an auditory stimulation device that is located proximate to the skull of the patient and which is operative to stimulate an auditory component of the patient in accordance with an output signal generated by the microphone. A subcutaneously routed signal wire may extend between the implanted microphone and the auditory stimulation device.

5 Claims, 5 Drawing Sheets

SOFT TISSUE PLACEMENT OF IMPLANTABLE MICROPHONE

CROSS REFERENCE TO RELATED APPLICATION

This application claims priority under 35 U.S.C. §119 to U.S. Provisional Application No. 60/692,224 entitled "Soft Tissue Placement of Implantable Microphone" having a filing date of Jun. 20, 2005 the entire contents of which are incorporated by reference.

FIELD OF THE INVENTION

The present invention relates to implanted microphone assemblies, e.g., as employed in hearing aid instruments, and more particularly, to implanted microphone assemblies having reduced sensitivity to undesired sources of vibration.

BACKGROUND

In the class of hearing aids generally referred to as implantable hearing instruments, some or all of various hearing augmentation componentry is positioned subcutaneously on, within or proximate to a patient's skull, typically at locations proximate the mastoid process. In this regard, implantable hearing instruments may be generally divided into two sub-classes, namely semi-implantable and fully implantable. In a semi-implantable hearing instrument, one or more components such as a microphone, signal processor, and transmitter may be externally located to receive, process, and inductively transmit an audio signal to implanted components such as a transducer. In a fully implantable hearing instrument, typically all of the components, e.g., the microphone, signal processor, and auditory stimulator, are located subcutaneously. In either arrangement, an implantable auditory stimulator device is utilized to stimulate a component of the patient's auditory system (e.g., tympanic membrane, ossicles and/or cochlea).

By way of example, one type of implantable transducer includes an electromechanical transducer having a magnetic coil that drives a vibratory actuator. The actuator is positioned to interface with and stimulate the ossicular chain of the patient via physical engagement. (See e.g., U.S. Pat. No. 5,702,342). In this regard, one or more bones of the ossicular chain are made to mechanically vibrate causing stimulation of the cochlea through its natural input, the so-called oval window.

As may be appreciated, hearing instruments that propose utilizing an implanted microphone, which include a diaphragm that will be covered by patient tissue, require that the microphone be positioned at a location that facilitates the transcutaneous receipt of ambient acoustic signals. For such purposes, an implantable microphone may be positioned (e.g., in a surgical procedure) between a patient's skull and skin, at a location rearward and upward of a patient's ear (e.g., in the mastoid region).

SUMMARY OF THE INVENTION

For a wearer of an implantable hearing instrument (e.g., middle ear or cochlear stimulation systems) that incorporates an implantable microphone, undesirable vibration (e.g., non-ambient vibration) carried by the wearer's tissue (e.g., skull and/or soft tissue) may be detected and amplified by the implantable microphone to an undesirable degree. For instance, operation of a middle ear transducer used with a hearing instrument may create vibration that is transmitted by the skull to the microphone. In this case, detection and amplification of the vibration can lead to objectionable feedback. Unwanted vibration (e.g., in the skull or other tissue) can also arise naturally from talking or chewing. In both cases, undesired vibrations may be transmitted to the site of the implanted microphone where a component of these undesired vibrations may be received by a microphone diaphragm and amplified.

It is therefore one objective to reduce the response of such hearing instruments to sources of non-ambient (i.e., undesired) vibration, without affecting the response of the microphone to desired signals (e.g., ambient sound). Another objective is to reduce the sensitivity of an implantable microphone to skull-borne vibrations. A yet further objective is to provide an implantable microphone having a reduced sensitivity to transducer feedback.

These and additional objectives are achieved by systems and methods (i.e., utilities) presented herein wherein an implantable microphone is positioned at a location spaced from the surface of the implantable hearing instrument wearer's (i.e., patient) skull. Stated otherwise, the microphone is mounted to a soft tissue of the patient to at least partially isolate the microphone from skull-borne vibrations. The utility further includes an auditory stimulation device that is operative to stimulate an auditory component of the patient in accordance with an output signal generated by the microphone. As will be appreciated, at least a portion of the auditory stimulation device will be located proximate to the skull of the patient. By utilizing a soft tissue mount, the microphone may be made more sensitive to ambient sounds with reduced concern to amplification of non-ambient vibrations caused by skull borne vibrations including, for example, transducer feedback, talking and/or chewing.

The microphone may be mounted to any soft tissue of the patient. Locations for such a soft tissue mounting include, without limitation, the neck, trapezius muscles, sternocleidomastoid muscles, pectoral muscles (e.g., sub-clavicle locations), external ear or pinna etc. Typically, it is desirable that any soft tissue mounting location provide at least 2 mm. of soft tissue between the microphone and any underlying bone. However, in any implantable hearing instrument arrangement, at least a portion of the implantable hearing instrument (e.g., the auditory stimulation device) is still typically mounted proximate to the patient's skull in order to access an auditory component (e.g., ossicle bone, oval window, cochlea, etc). Accordingly, interconnection of the soft tissue mounted microphone to the skull-mounted portion of the hearing instrument may require use of an interconnecting signal wire. Such a signal wire may be routed subcutaneously between the microphone and the hearing instrument. Mounting the microphone to the patient's neck or pinna reduces the distance between the microphone and the skull mounted portion of the hearing instrument and may thereby facilitate implantation. That is, mounting the microphone to the neck or pinna may allow for positioning the microphone via a common incision that is also utilized to interconnect the auditory stimulation device to the auditory component of the patent. For more distal microphone positioning, an interconnecting signal wire may have to be routed subcutaneously utilizing, for example a cannula or catheter. In such distal positioning arrangements, the microphone and auditory stimulation devices may be implanted via distinct incisions. Alternatively, a wireless link (e.g., RF) may be established between the microphone and the skull-mounted portion of the hearing instrument.

In one arrangement, the microphone is mounted to the soft tissue of a patient's neck in a triangular region having a base bounded inferiorly by the clavicle, anteriorly by the sternocleidomastoid muscle, and posteriorly by the trapezius muscle. These two muscle structures form an apex at the tip of the mastoid process on the patient's skull. Placement within this triangular region (e.g., between the muscle structures) may facilitate implantation of the microphone. For instance, during implant procedure an incision may be made in the mastoid process in order to interconnect a hearing instrument to the patient's auditory system. Positioning the microphone at a position proximate to the mastoid tip may allow implantation of the microphone through the hearing instrument incision. That is, a surgeon may tunnel down from the hearing instrument incision and form a pocket for the microphone beneath the skin of the patient's neck. Accordingly, the interconnecting wire may be routed during such a procedure. In another arrangement the microphone is positioned in the external ear (pinna, concha, or lobe). In a further arrangement, the microphone is positioned below the clavicle of the patient. In such an arrangement, any connecting signal wire will require a length of at least about 15 cm.

Various refinements exist of the features noted in relation to the present invention. Such refinements and additional features may exist individually or in any combination. For instance, more than one microphone may be utilized by the hearing instrument. In this regard, two or more microphones may be positioned to increase gain and/or provide for directionality. Accordingly, the microphones may be implanted at separate locations (e.g. one directed forward and one directed rearward).

According to a further aspect of the invention, a system and method (i.e. utility) is provided for isolating an implantable microphone from skull-borne vibrations. The utility includes positioning an implantable microphone at a subcutaneous location where the microphone is supported by soft tissue of the patient and is spaced from the skull of the patient. A signal wire is routed subcutaneously between the implantable microphone and an auditory stimulation device located proximate to the skull of the patient. The auditory stimulation device is operative to stimulate an auditory component of a patient in accordance with an output signal generated by the implantable microphone.

Generally, an implantable microphone may be implanted in any subcutaneous location that provides an adequate soft tissue mounting location. Typically, such location will provide at least 2 mm of soft tissue overlying any bones in the mounting location. Further, such location will typically be within 2 to 8 mm of the dermal surface of the patient to allow for transcutaneous receipt of ambient acoustic signals.

DETAILED DESCRIPTION

Reference will now be made to the accompanying drawings, which at least assist in illustrating the various pertinent features of the present invention. In this regard, the following description of a hearing aid device is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
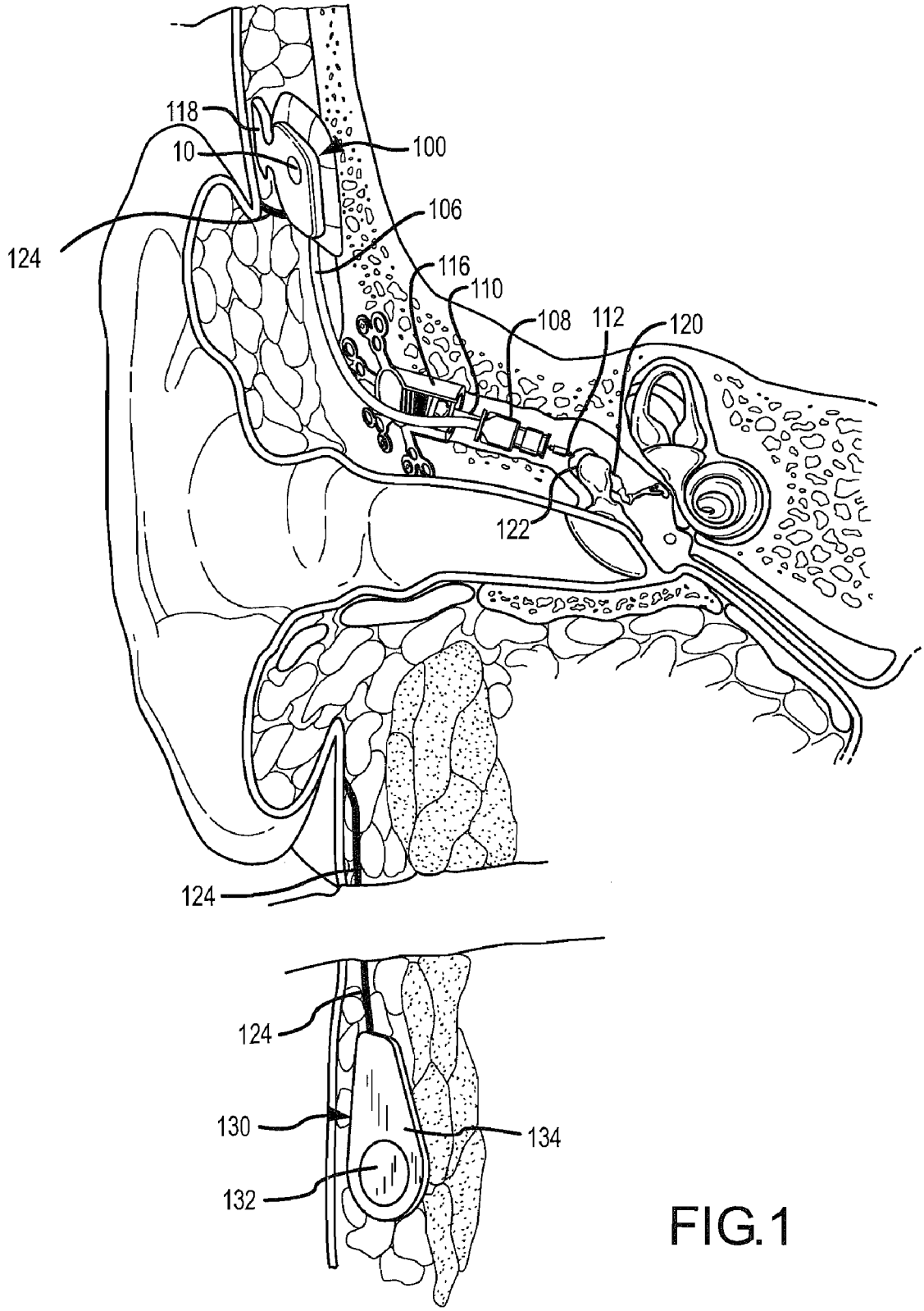
FIG. 1 illustrates a fully implantable hearing instrument.
Figure 2:
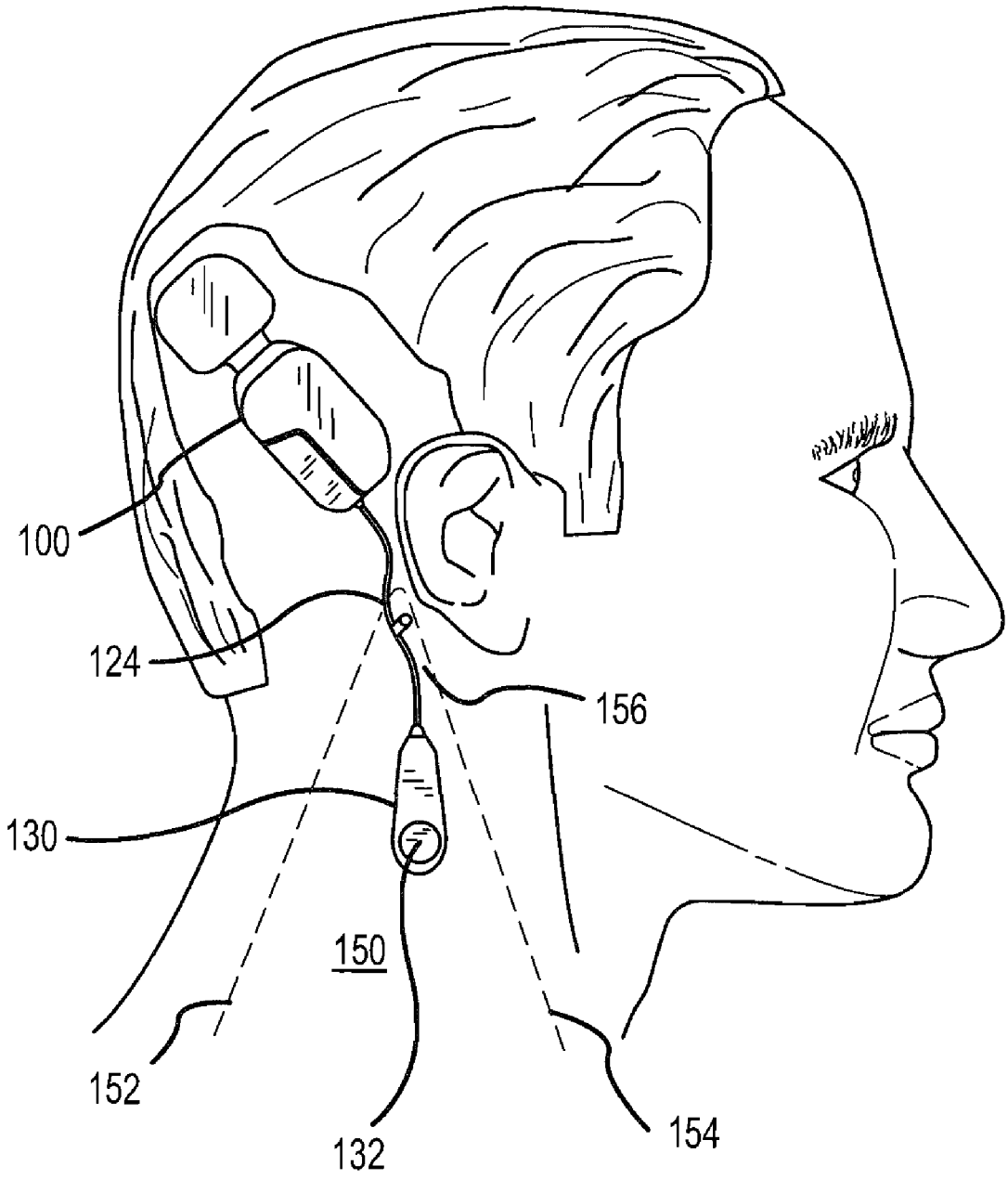
FIG. 2 illustrates one embodiment of a soft tissue mount of a microphone.

FIGS. 1 and 2 illustrate one application of the present invention. As illustrated, the application comprises a fully implantable hearing instrument system. As will be appreciated, certain aspects of the present invention may be employed in conjunction with semi-implantable hearing instruments as well as fully implantable hearing instruments, and therefore the illustrated application is for purposes of illustration and not limitation.

In the illustrated system, a biocompatible implant housing 100 is located subcutaneously on a patient's skull. The implant housing 100 includes a signal receiver 118 (e.g., comprising a coil element) and is interconnected to a microphone assembly 130 via a signal wire 124. The implant housing 100 may be utilized to house a number of components of the implantable hearing instrument. For instance, the implant housing 100 may house an energy storage device and a signal processor. Various additional processing logic and/or circuitry components may also be included in the implant housing 100 as a matter of design choice. In the present arrangement, the signal processor within the implant housing 100 is electrically interconnected via a signal wire 106 to a transducer 108.

The transducer 108 is supportably connected to a positioning system 110, which in turn, is connected to a bone anchor 116 mounted within the patient's mastoid process (e.g., via a hole drilled through the skull). The transducer 108 includes a connection apparatus 112 for connecting the transducer 108 to the ossicles 120 of the patient. In a connected state, the connection apparatus 112 provides a communication path for acoustic stimulation of the ossicles 120, e.g., through transmission of vibrations to the incus 122.

The microphone assembly 130 is spaced from the implant housing 100 such that it is not mounted to the skull of a patient. Such spacing facilitates vibration attenuation, as will be more fully discussed herein. The microphone assembly 130 includes a diaphragm 132 that is positioned to receive ambient acoustic signals through overlying tissue, a microphone transducer (not shown) for generating an output signal indicative of the received ambient acoustic signals, and a housing 134 for supporting the diaphragm 132 relative to the transducer. As shown, the microphone assembly 130 is mounted to soft tissue of the neck of the patient and the wire 124 interconnecting the implant housing 100 and the microphone assembly 130 is routed subcutaneously behind the ear of the patient.

During normal operation, acoustic signals are received subcutaneously at the diaphragm 132 of the microphone assembly 130. The microphone assembly 130 generates an output signal that is indicative of the received acoustic signals. The output signal is provided to the implant housing 100 via a signal wire 124. Upon receipt of the output signal, a signal processor within the implant housing 100 processes the signals to provide a processed audio drive signal via a signal wire 106 to the transducer 108. As will be appreciated, the signal processor may utilize digital processing techniques to provide frequency shaping, amplification, compression, and other signal conditioning, including conditioning based on patient-specific fitting parameters. The audio drive signal causes the transducer 108 to transmit vibrations at acoustic frequencies to the connection apparatus 112 to effect the desired sound sensation via mechanical stimulation of the incus 122 of the patient.

To power the fully implantable hearing instrument system of FIG. 1, an external charger (not shown) may be utilized to transcutaneously re-charge an energy storage device within the implant housing 100. In this regard, the external charger may be configured for disposition behind the ear of the implant wearer in alignment with the implant housing 100. The external charger and the implant housing 100 may each include one or more magnets 10 to facilitate retentive juxtaposed positioning. Such an external charger may include a power source and a transmitter that is operative to transcutaneously transmit, for example, RF signals to the signal receiver 118.

As noted above, the microphone assembly 130 is spaced from the implant housing 100 such that it is not mounted on the skull of a patient. That is, by spacing the microphone assembly 130 from the skull, vibrations within the skull that may result from, for example, transducer feedback and/or biological sources (e.g., talking and/or chewing) may be attenuated prior to reaching the microphone assembly 130. Stated otherwise, mounting the microphone assembly 130 relative to soft tissue of the patient substantially isolates the microphone assembly 130 from one or more sources of non-ambient vibrations (e.g., skull-borne vibrations).

As shown in FIG. 2, the microphone assembly 130 is mounted to the soft tissue in a patient's neck in a triangular region 150 having a base bounded inferiorly by the clavicle (not shown), anteriorly by the sternocleidomastoid muscle 154, and posteriorly by the trapezius muscle 152. These two muscle structures 152, 154 form an apex at the tip 156 of the mastoid process on the patient's skull. Such placement within this triangular region (e.g., between the muscle structures) may facilitate implantation of the microphone assembly 130. For instance, during an implant procedure an incision may be made in the mastoid process in order to interconnect the hearing instrument to the patient's auditory system. Positioning the microphone assembly 130 at a position proximate to the mastoid tip allows implantation of the microphone assembly 130 through an incision formed for the hearing instrument. That is, a surgeon may tunnel down from the hearing instrument incision and form a small pocket for the microphone assembly 130 beneath the skin of the patient's neck. Accordingly, the wire 124 interconnecting the implant housing 100 and the microphone assembly 130 may be routed during such a procedure.

Figure 3:
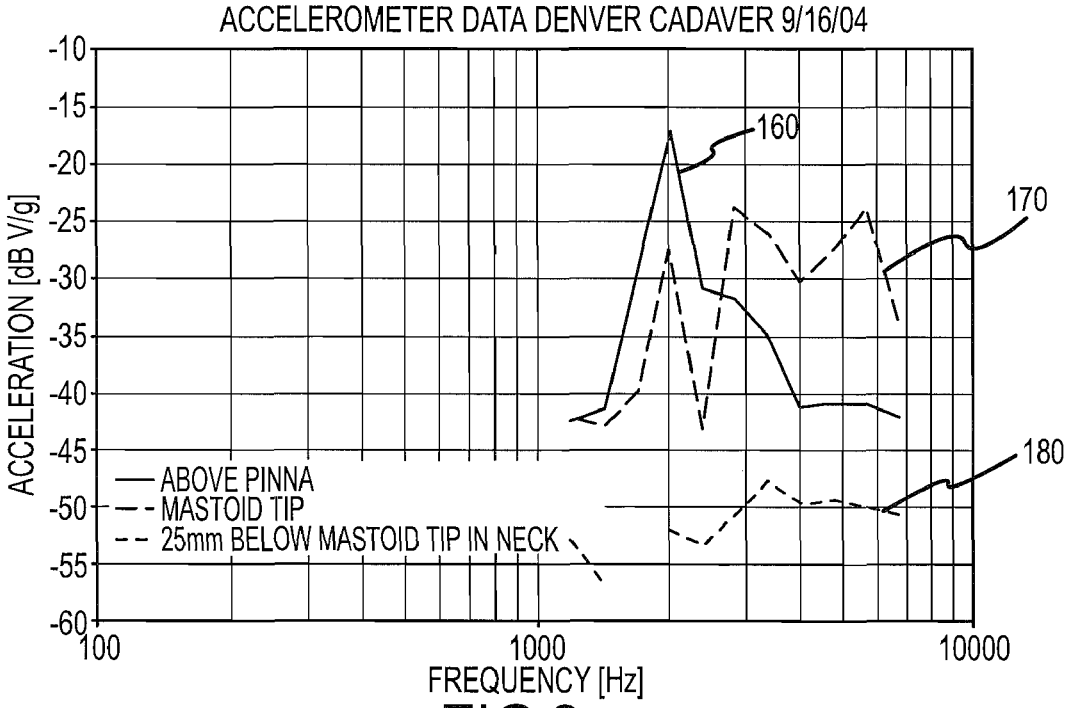
FIG. 3 is a graph illustrating acceleration caused by skull-borne vibrations at various mounting locations.
Figure 4:
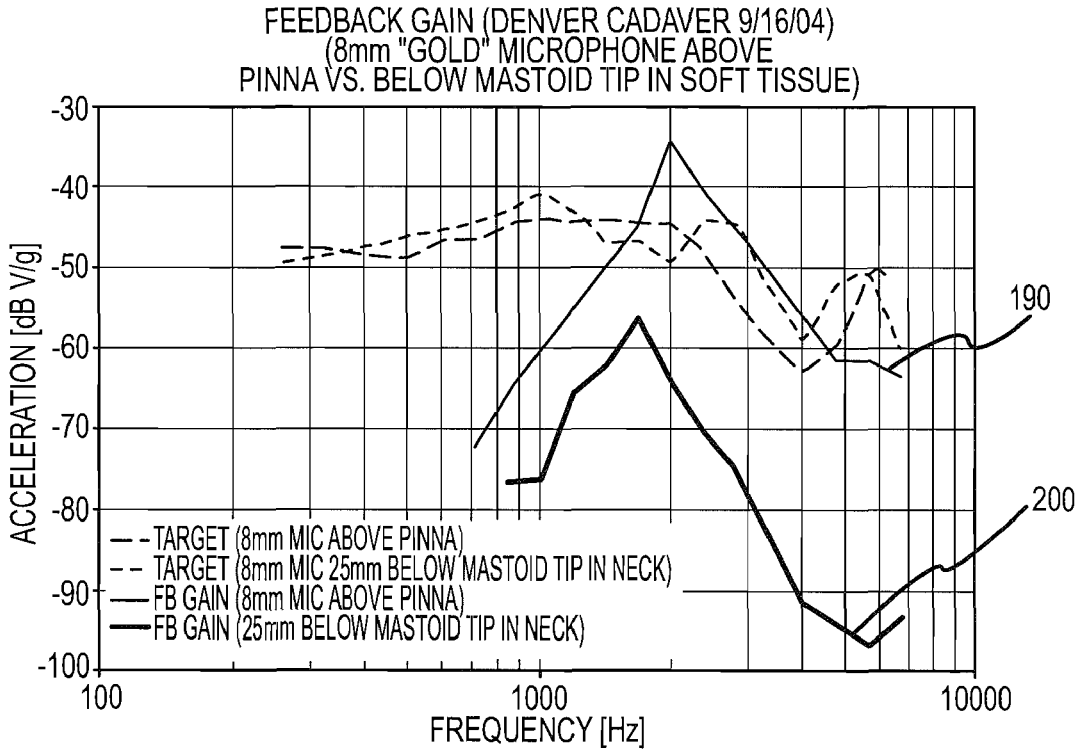
FIG. 4 is a graph showing transducer feedback at first and second mounting locations.

FIGS. 3 and 4 illustrate the receipt of non-ambient vibrations at the microphone assembly 130 at various mounting locations. Specifically, FIG. 3 illustrates acceleration data for three different mounting locations where a source of skull-borne vibration initiates an acceleration in the patient's tissue that may be received by the microphone assembly 130. The data corresponds with locations directly above the pinna 160, the mastoid tip 170, and a soft tissue mount 180 in the neck that is 25 mm below the mastoid tip. As will be appreciated, the pinna 160 and mastoid tip 170 mounting locations are proximate the skull of the patient. Accordingly, these skull mount locations 160, 170 are more directly subjected to acceleration caused by skull-borne vibrations. As shown, the acceleration level at the soft tissue mount 180 in the neck is 10 to 20 dB lower than at the skull-mounted locations 160, 170 for frequencies above 2 kHz.

FIG. 4 illustrates feedback gain caused by operation of the transducer 108 of the hearing instrument. That is, actuation of the transducer results in the generation of skull-borne vibrations that may be received and amplified by the microphone assembly 130. FIG. 4 illustrates the received feedback (e.g., vibration) for two separate microphone assembling mounting locations, namely a skull mount location 190 that is 8 mm above the pinna and a soft tissue mount 200 located 25 mm below the mastoid tip. As with the acceleration data above, the feedback gain measurements made at the soft tissue mount 200 in the neck show a pronounced improvement. For instance, over the range of 1 kHz to 6 kHz, the feedback gain at the soft tissue mount 200 was 10 to 35 dB lower than at the skull mount 190 above the pinna.

Figure 5:
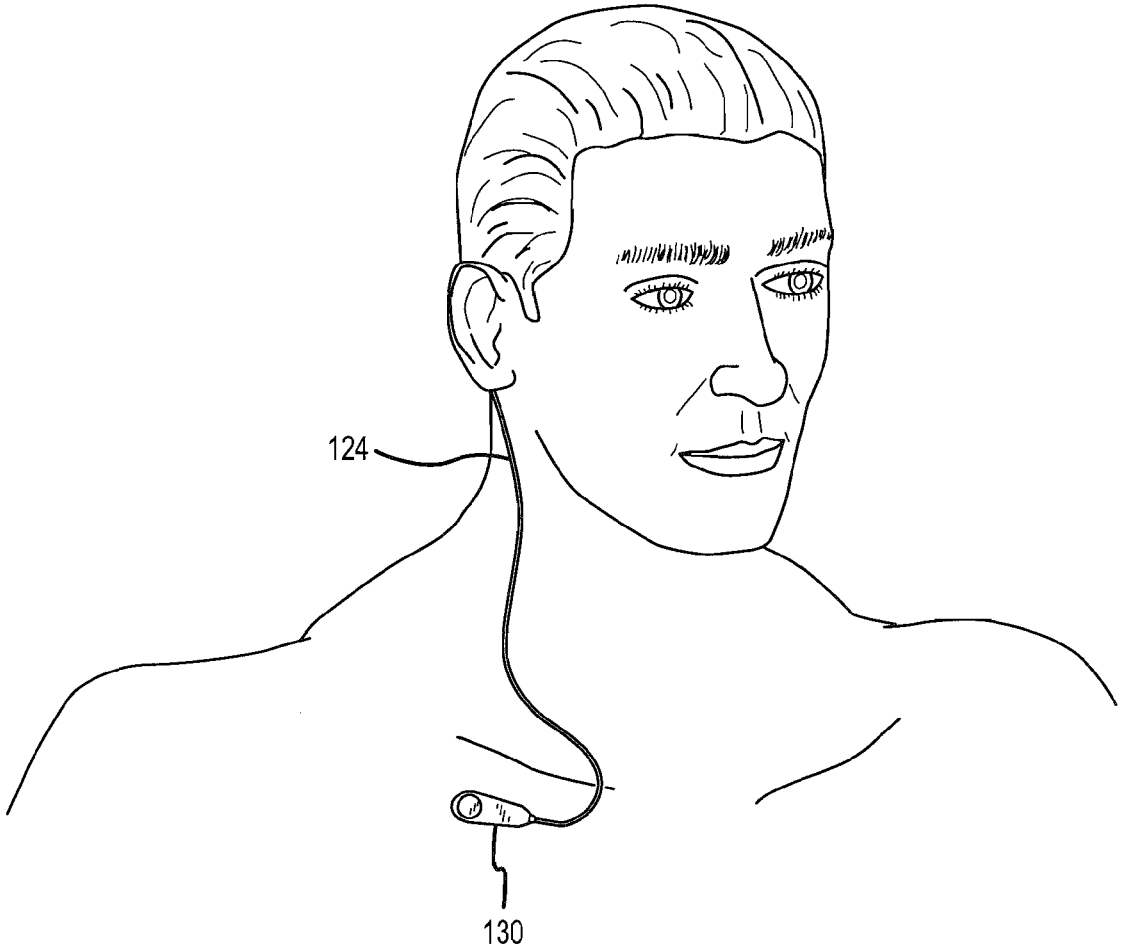
FIGS. 5 and 6 illustrate additional embodiments of a soft tissue mount of a microphone.

FIG. 5 illustrates another embodiment where the microphone assembly 130 is mounted to the soft tissue of a patient's chest. More specifically, FIG. 5 illustrates a sub-clavicle mounting where the microphone assembly 130 is positioned beneath the patient's clavicle. In such an arrangement, the signal wire 124 extending between the microphone 130 and the implant housing 100, or other portion of the hearing instrument disposed proximate to the skull (not shown), may need to be considerably longer than the signal wire utilized for mounting the microphone to soft tissue in the patient's neck. For instance, the signal wire 124 may require of length greater than 15 cm, greater than 20 cm or even greater than 30 cm.

Figure 6:
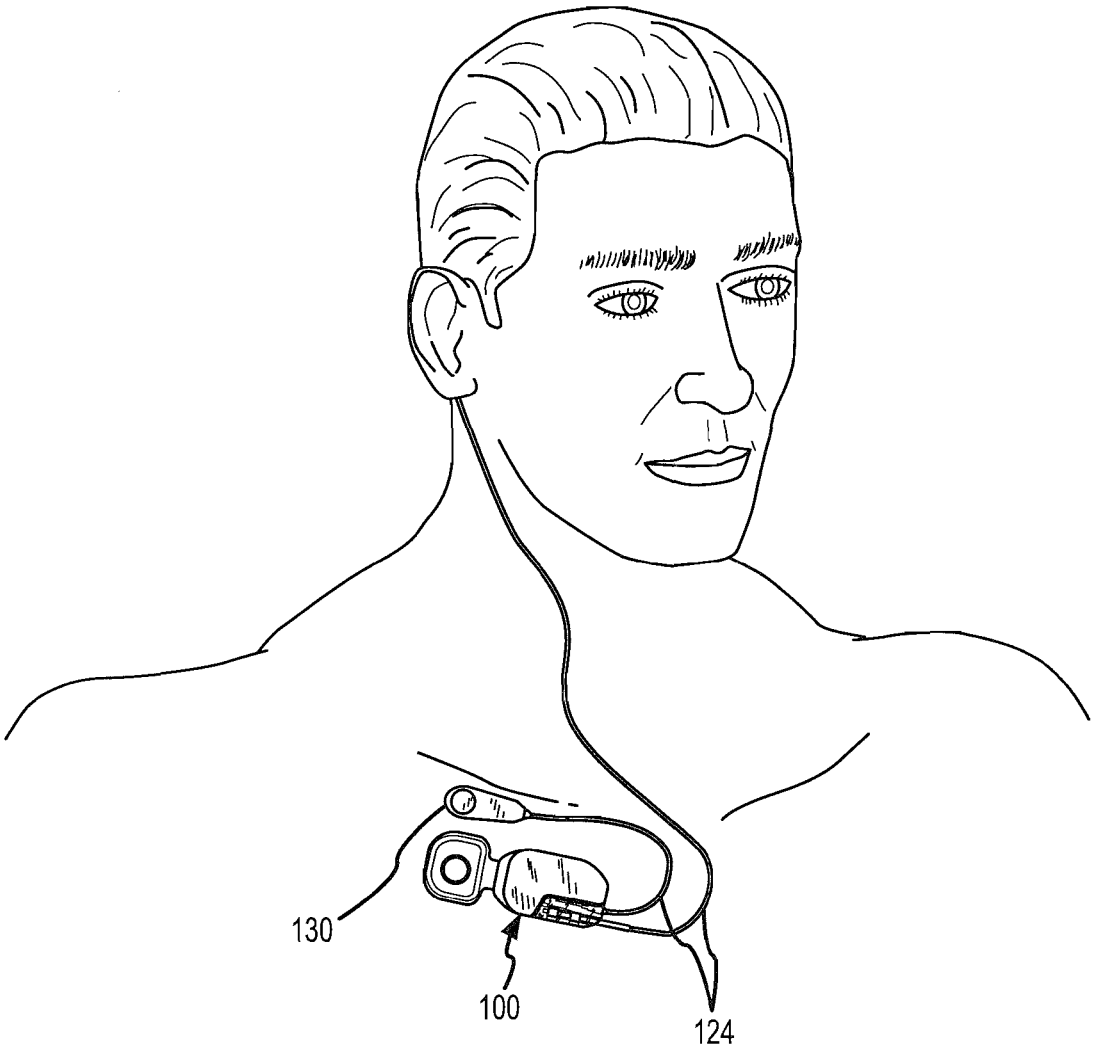

FIG. 6 illustrates a further embodiment where an implant housing 100 is co-located with the microphone assembly 130. In a further arrangement, the microphone assembly may be incorporated into the implant housing (not shown).

Implantation of the microphone assembly 130 at increased distances from the skull mounted portion of the implantable hearing instrument may require that the signal wire 124 be detachably connectable to one or both of microphone assembly 130 and the skull mounted portion of the implantable hearing instrument. In this regard, one or both ends of the wire 124 may include a detachable connector. One detachable connector that may be utilized is illustrated in U.S. Pat. No. 6,517,476, entitled: "Connector for implantable hearing aid" having an issue date of Feb. 11, 2003, the contents of which are incorporated herein by reference.

Implantation of the microphone assembly at increased distances from a skull-mounted portion of the hearing instrument may require separate incisions. For example, in reference to FIG. 5, the implant housing 100 and an associated auditory stimulation device (e.g., mechanical transducer, electrode array, etc) may be implanted via a first incision and the microphone assembly 130 may be implanted via a second incision at, for example, a sub-clavicle location. The wire 124 may then be routed using, for example, a flexible catheter, a trocar, cannula, etc., that is inserted in one of the incisions and routed beneath the skin of the patient to the other incision.

In either of the above-noted arrangements, the microphone assembly 130 is preferably disposed over soft tissue. That is, the microphone assembly is not in direct contact with a bone surface as such a surface is highly effective in transferring vibrations to the microphone assembly. Typically, it is desirable that at least 2 mm. of soft tissue be disposed between the microphone assembly and any underlying bone. In order to maintain the position of the assembly 130 relative to the soft tissue, the assembly may be sutured to such soft tissue.

The soft tissue mount allows for attenuating and/or eliminating the transfer of skull borne vibrations to the microphone assembly 130. However, it will be noted that move ment of the microphone assembly may result in the enhancement or introduction of other sources of non-ambient sound. For instance, sub-clavicle mounting of the microphone assembly may result in the application of cardio-pulmonary signals to the assembly. Accordingly, it may be desirable to process the microphone output signal(s) to reduce the effect of such non-ambient sound. One arrangement that may be utilized to reduce the effects of non-ambient sound is described in U.S. patent application Ser. No. 11/330,788 entitled: "Active vibration attenuation for implantable microphone," having a filing date of Jan. 11, 2006, the entire contents of which are incorporated herein by reference.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

The invention claimed is:

1. A method for use with an implantable hearing instrument, comprising:

positioning an implantable microphone at a subcutaneous location, wherein said implanted microphone is supported by soft tissue and is spaced from a surface of the skull of the patient; and routing a signal wire subcutaneously between said implantable microphone and an auditory stimulation device mounted relative to the skull of the patient, wherein the auditory stimulation device is operative to stimulate an auditory component of a patient in accordance with an output signal generated by said implantable microphone.

2. The method of claim 1, wherein positioning comprises:

positioning said implantable microphone at a subcutaneous location wherein at least 2 mm of soft tissue is disposed between said microphone and any underlying patient bone.

3. The method of claim 1, wherein positioning comprises:

positioning said implantable microphone at a subcutaneous location in the neck of the patient.

4. The method of claim 1, wherein positioning comprises:

positioning said implantable microphone at a location below a clavicle of the patient.

5. The method of claim 1, wherein said microphone is spaced at least 5 cm from a surface of the skull of the patient.

* * * * *